United States Patent [19]

Kawakita et al.

[11] 4,456,577

[45] Jun. 26, 1984

[54] METHODS FOR PRODUCING COMPOSITE ROTARY DRESSER

[75] Inventors: Takao Kawakita, Osaka; Kazuo Yamaguchi, Hyogo; Sadao Date, Osaka, all of Japan

[73] Assignee: Osaka Diamond Industrial Company, Ltd., Sakai, Japan

[21] Appl. No.: 376,992

[22] Filed: May 11, 1982

[30] Foreign Application Priority Data

Sep. 25, 1981 [JP] Japan ..... 56-152493
Nov. 13, 1981 [JP] Japan ..... 56-182909

[51] Int. Cl.[3] ..... B22F 7/00; B22F 7/06; B22F 7/02; B22F 7/04

[52] U.S. Cl. ..... 419/7; 419/9; 419/11; 419/13; 419/58; 428/556; 428/557

[58] Field of Search ..... 419/5, 6, 7, 8, 9, 11, 419/13, 27, 38, 39, 47, 58; 428/556, 557

[56] References Cited

U.S. PATENT DOCUMENTS

| | | | |
|---|---|---|---|
| 2,145,888 | 2/1939 | Moulton et al. | 428/557 X |
| 2,238,382 | 4/1941 | Boegehold | 419/47 X |
| 2,401,221 | 5/1946 | Bourne | 419/47 |
| 2,753,859 | 7/1956 | Bartlett | 419/27 X |
| 3,359,623 | 12/1967 | Gwyn, Jr. | 419/27 X |
| 3,360,348 | 12/1967 | Schreiner | 419/5 X |
| 3,780,418 | 12/1973 | Hurst | 419/6 X |
| 3,889,349 | 6/1975 | Kaufman | 419/6 X |
| 4,008,520 | 2/1977 | Rothkegel et al. | 419/27 X |

FOREIGN PATENT DOCUMENTS

| | | | |
|---|---|---|---|
| 632323 | 11/1949 | United Kingdom | 419/27 |
| 1264482 | 2/1972 | United Kingdom | 419/27 |

OTHER PUBLICATIONS

Jones, W. D. *Fundamental Principles of Powder Metallurgy* E. Arnold Publishers, London, 1960, pp. 476–481, 508–509.

*Primary Examiner*—Benjamin R. Padgett
*Assistant Examiner*—Matthew A. Thexton
*Attorney, Agent, or Firm*—Sughrue, Mion, Zinn, Macpeak and Seas

[57] ABSTRACT

A method of producing a rotary dresser include forming a core piece of an iron-base powder and filling in tungsten or like metal powder between the core and an outer mold member containing diamond grit or the like. The construction is then heated to melt and infiltrate a metal alloy, such that a network structure is formed about the powdered metal particles. In a further embodiment, the metal materials may be arranged in concentric form about a metal bushing such that the bushing is included in the final structure.

10 Claims, 11 Drawing Figures

METHODS FOR PRODUCING COMPOSITE ROTARY DRESSER

BACKGROUND OF THE INVENTION

This invention relates to a method for producing rotary dressers. Known manufacturing processes of this type are primarily divided into two types; electro-plating process and sintering-infiltration process.

The former process utilizes an electrically deposited metal layer for cementing super-abrasive grit such as diamond or cubic boron nitride (CBN). There are reverse electro-plating type and single-layer surface type of this process. On the other hand, the latter process utilizes a sintered metal to cement super-abrasive grit such as diamond or CBN. Among the rotary dressers made by this process, there are single- and multi-layer grit types. This invention relates to the latter type process, i.e., a method utilizing sintering-infiltration. An outline of a conventional process utilizing this method will now be explained.

FIG. 1 shows a negative mold 1 made of, for instance, graphite. Super-abrasive grit 3 such as diamond or CBN are set on the mold surface 2 (the inner diameter surface). A core piece 4 is then placed in the assembly, as is shown in FIG. 2, and a metallic powder 5 is filled in the space between the mold surface 2 of the negative mold 1 and the outer diameter of core piece 4.

Infiltrant material 6 is put on the metal powder 5, and the whole construction is heated to a temperature above the melting point of the infiltrant. The infiltrant thus melts down and penetrates into the voids of the metal powder filling 5. After the cooling and solidifying of the infiltrant, an infiltrated solid body cementing the super-abrasive grit 3 and metal powder 5 is obtained. The negative mold 1 and core piece 4 are then removed, and the infiltrated solid body is machined to the specified dimensions and shape. Thus a rotary dresser as shown in FIG. 3 having super-abrasive surface 7 is obtained.

An expensive metal powder such as tungsten is generally used as the above-mentioned metal powder 5, because the metal powder must be highly heat- and wear-resistant. In order to minimize the use of metal powder 5, in some cases, a core piece 8 generally made of iron or iron alloy is placed in the center of negative mold 1, as is shown in FIG. 4, so that the space between the mold surface 2 of negative mold 1 and the outer diameter of core piece 8 becomes as narrow as possible. The tungsten is filled in said space, treated by the above-mentioned infiltration process, and finally finished to make the core piece 8 a part of the rotary dresser. FIG. 5 shows an example of the rotary dresser made by the above-mentioned method.

As is shown in FIG. 5, the rotary dresser has a sintered metal powder such as tungsten 9 formed on the outer diameter of the core piece 8, and a super-abrasive surface 7. As is explained above, the use of a core piece of iron or iron alloy makes it possible to minimize the use of expensive tungsten powder. However, where the core piece is used, the strength of the junction between the core piece 8 and the sintered metal powder 9 is equal only to the brazing strength between the core piece 8 and sintered metal powder 9, which are essentially different metallic materials. If the infiltration of infiltrant 6 is insufficient or if the wetting of the infiltrant 6 on the core piece 8 is poor, poor brazing is observed; and thus the strength of the junction between core piece 8 and the sintered metal powder 9 becomes poor. It is not seldom that the separation of core piece 8 and sintered metal powder 9 is observed. The big difference in the thermal expansion coefficients of the two different materials, i.e., the core piece 8 and the sintered metal powder 9, causes large internal stresses during cooling after infiltration and results in a strain on the super-abrasive surface 7, which translates into a deterioration in the accuracy of the rotary dresser.

SUMMARY OF THE INVENTION

In view of the foregoing, it is an object of this invention to provide a rotary dresser production method eliminating those problems enumerated above with respect to the prior art. This is achieved according to one aspect of the present invention by eliminating the inner bushing or the like and replacing the same with a powdered metal compact.

DETAILED DESCRIPTION OF THE INVENTION

Figure 1:
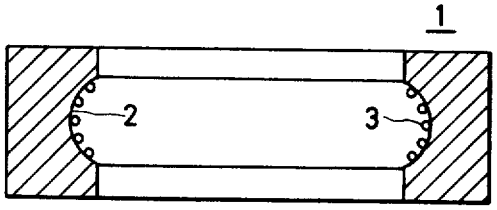
FIGS. 1 and 2 show a conventional method for producing rotary dressers.
Figure 2:
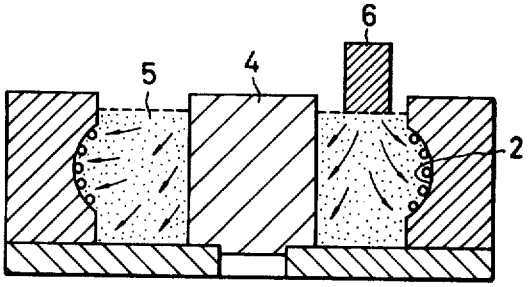
Figure 4:
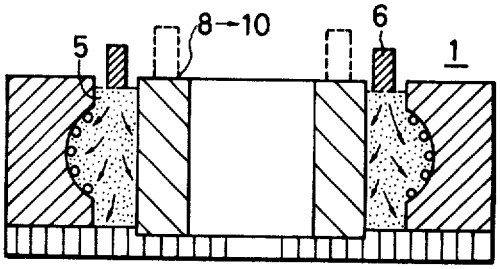
FIG. 4 shows a general method for producing a rotary dresser having an embedded core piece.
Figure 3:
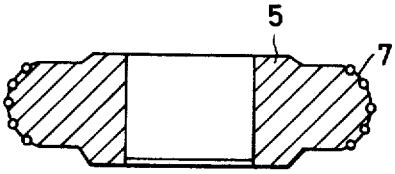
FIG. 3 is a section of a rotary dresser produced by the conventional method shown in FIGS. 1 and 2.
Figure 5:
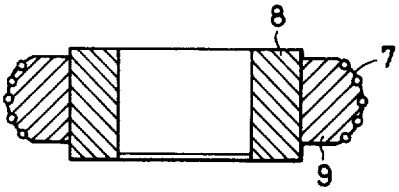
FIG. 5 is a section of a conventional rotary dresser having an iron or iron alloy body as a core piece.

In a first process of this invention, after setting super-abrasive grit such as diamond or CBN on the circular mold surface 2 of the negative mold 1 in FIG. 4, a cylindrical iron-base powder compact 10 of specified dimensions is placed in the center of negative mold 1 instead of the core piece 8. A heat- and wear-resistant metal powder 5 such as tungsten is then filled in the space between the mold surface 2 and the outer diameter of said iron-base powder compact 10, and an infiltrant 6 made of, for instance, Cu—Ni—Zn base alloy is placed on the metal powder. The whole construction is then heated up to a temperature above the melting point of the infiltrant. Infiltrant thus melts down and penetrates into voids in the metal powder 5 and in the iron-base powder compact 10. After infiltration and solidification of the infiltrant, the infiltrated solid body is separated from the negative mold 1 and finished to the specified dimensions and accuracy. The infiltrant 6 in FIG. 4 can be put either on the metal powder filling or on the iron-base powder compact 10, as is shown with broken lines in FIG. 4.

Regarding the iron-base powder compact 10, the main component thereof is iron or iron alloy powder. Additive elements commonly known in the field of powder metallurgy and steel engineering, for instance, Cu, Ni, and C powders, are added. The compact of said powder mixture can be used either sintered or green (non-sintered). Also, the iron-base powder compact 10 can be either infiltrated or non-infiltrated before use.

As is explained above, the invention intends to strengthen the junction between the core material and, the infiltrated tungsten powder by using an iron-base powder compact as a core piece. For comparison, test samples were made by following the conventional process and that of this invention.

Tungsten powder of 8.8 g/cm$^3$ apparent density was contacted with the test samples shown in Table 1, and an infiltrant composed mainly of Cu—Ni—Zn (890° C. melting point) was put on the said powder filling. The whole assembly was heated to 1030° C. in a protective atmosphere. The infiltrant was melted and infiltrated into the tungsten powder, and the test pieces were joined to the infiltrated tungsten powder. After solidification of the melted infiltrant and cooling, the welding strengths between the infiltrated tungsten powder and the test pieces were measured:

TABLE 1

| Test sample | Welding strength (Kg/mm$^2$) |
|---|---|
| S25C (non-treated) | 0.72 |
| S25C plated with Ni | 1.43 |
| S25C plated with Cu | 1.97 |
| Fe—2% Cu—0.8% C sintered alloy (apparent density: 5.9 g/cm$^3$) | 7.45 |
| Fe—2% Cu—0.8% C sintered alloy (apparent density: 5.9 g/cm$^3$) (infiltrated beforehand) | 13.05 |

S25C in Table 1 is carbon steel as specified by the JIS.

Figure 6:
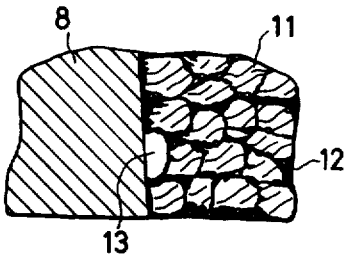
FIG. 6 is a schematic drawing showing the boundary of the iron or iron alloy body and an infiltrated tungsten powder.
Figure 7:
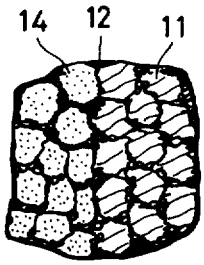
FIG. 7 is a schematic drawing showing the boundary of an iron-base powder compact and an infiltrated tungsten powder produced by the invention.

From Table 1, it will be understood that S25C is increased in welding strength by 2-3 times when it is plated with Ni or Cu. However, the welding strength can be increased to more than 10 times that of non-treated S25C if the method of this invention is adopted. The above results are explained with schematic drawings FIG. 6 and FIG. 7. FIG. 6 shows the use of an iron or iron alloy body as the core piece, while FIG. 7 shows the use of an iron-base powder compact as the core piece. In FIG. 6, the iron or iron alloy body 8 is joined to the powder particle 11 by infiltrant 12. The welding strength, however, can not exceed the brazing strength between the iron alloy body 8 and the infiltrant. It is often the case that the welding strength decreases due to voids 13 which are the result of poor wetting of the iron alloy body 8.

On the other hand, in FIG. 7 an iron-base powder compact is used as the core piece, and the infiltrant 12 forms a complete network which joins the iron and tungsten powder particles 14.

In Table 1, the iron-base powder compact (non-infiltrated) is a Fe-2%Cu-0.8%C powder compact having 5.9 g/cm$^3$ apparent density. If the apparent density of the powder compact is less than 3.0 g/cm$^3$, the strength of the powder compact is too low. Moreover, if the apparent density of the powder compact is more than 7.2 g/cm$^3$, the interconnecting porosity of the compact is too small to permit sufficient infiltration. Thus, the apparent density of the iron-base powder compact should be fixed within the above-mentioned range.

As for the additive elements in the iron-base powder compact, the following conditions exist:

Cu 0.01-20%—Addition of less than 0.01% has little effect, whereas the addition of more than 20% eliminates the porosity of the powder compact.

Ni 0.01-10%—Addition of less than 0.01% has little effect, whereas the addition of more than 10% results in the segregation of Ni which diminishes the effect of Ni addition.

C 0.01-4.5%—Addition of less than 0.01% has little effect, whereas the addition of more than 4.5% results in a cast-iron structure of poor strength.

The quantity of each additive element thus should be limited to the abovementioned ranges. In the invention, molybdenum powder can be used instead of tungsten powder.

As is explained above, the welding strength between the inner surface of the infiltrated tungsten or like powder and the outer surface of the infiltrated iron-base powder compact can be remarkably increased. The whole construction is formed as an infiltrated powder compact which has high damping capabilities. Thus, no abnormal vibrations during the use of the rotary dressers is observed.

During the process of producing the rotary dressers of the invention, no strain on the super-abrasive surface caused by the difference in the thermal expansion coefficients is observed. Thus, very highly accurate rotary dressers can be obtained.

In a second method according to the invention, the core or inner bushing member is not dispensed with, but instead, the rotary dressers are produced in the following way: After setting super-abrasive grit such as diamond on the shaped surface of the negative mold and placing a core piece of bushing inside the mold, an iron-base powder mixture and the tungsten-base powder mixture are concentrically filled in the space between the shaped surface and core piece or bushing. An infiltrant material such as Cu—Ni—Zn base alloy is then melted and infiltrated into the powder mixtures. The iron-base powder swells when Cu atoms dissolve into the iron during infiltration, compensating for the shrinkage of the tungsten metal powder during infiltration. Thus, the total dimensional change during infiltration becomes very small.

Figure 8:
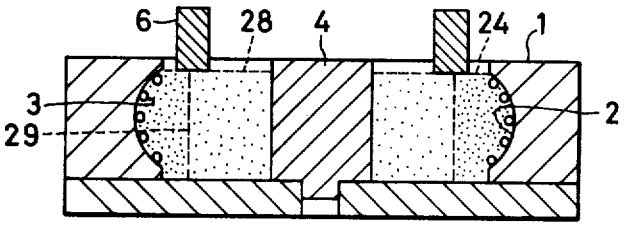
FIG. 8 illustrates a second method according to the invention.

The practice of this method of the invention is illustrated in FIG. 8. As explained above, a core piece 4 is placed in the negative mold 1. Metal powders such as a tungsten-base powder mixture 24 and iron-base powder mixture 28 are filled concentrically from the outer side in the space between the inner circular surface of negative mold 1 and the outer diameter of the core piece 4. As an example of a method of filling two kinds of powder mixtures concentrically, a cylindrical separating wall 29 may be placed beforehand at the position of the border of the metal powder 24 and the iron-base powder mixture 28. The powder 24 is then filled in the space between the separating wall 29 and inner circular surface of the negative mold 1, on which super-abrasive grit 3 have been set beforehand. The iron-base powder mixture 28 is then filled in the space between core piece 4 and separating wall 29, after which the wall 29 is pulled out. The composition of the iron-base powder mixture will be explained afterward.

Figure 9:
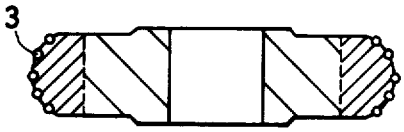
FIGS. 9 and 10 are sectional views of rotary dressers produced by the second method; and, FIG. 11 is a perspective view of an inner bushing used according to the invention.
Figure 10:
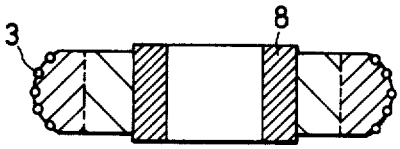
Figure 11:
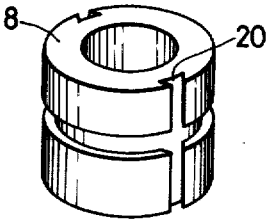

Infiltrant 6 is placed on the concentric double layer of powder fillings, and the whole construction is heated to a temperature above the melting point of the infiltrant. After infiltration, the infiltrated body is machined in the same manner as a conventional rotary dresser. Thus, the rotary dresser shown in FIG. 9 is produced by the invention. As is explained above, Cu—Ni—Zn alloy or other alloys can be used as the infiltrant. In the practice of this invention as explained in FIG. 8, the core piece 4 is retained. If this core piece is replaced by a bushing, as illustrated in FIG. 4, and infiltration is performed, a rotary dresser having a bushing, as is shown in FIG. 10 is obtained. In this case, if an iron-base sintered compact, or an iron alloy body of, for example, stainless steel, having reverse tapered grooves 20 to prevent slip as shown in FIG. 11 is used as the bushing, the junction between the bushing 8 and the infiltrated body will be perfect.

As an example of this method of the invention, a tungsten powder filling of 8.8 g/cm$^3$ apparent density was placed in contact with the test samples shown in Table 2, and an infiltrant composed mainly of Cu—Ni—Zn (890° C. melting point) was put on the powder filling. The whole assembly was heated to 1030° C. in a protective atmosphere. The infiltrant was melted and infiltrated to weld the infiltrated tungsten body and the test samples. After cooling and solidification, the welding strength between the infiltrated tungsten powder and the test samples was measured:

TABLE 2

| No. | Test sample (powder mixture) % | | | Transverse rupture strength, kg/mm$^2$ |
|---|---|---|---|---|
| 1 | Fe 100 | | | 6.4 |
| 2 | Fe 99.2 | C 0.8 | | 7.9 |
| 3 | Fe 98 | Cu 2 | | 5.0 |
| 4 | Fe 92 | Cu 8 | | 5.1 |
| 5 | Fe 84 | Cu 16 | | 4.2 |
| 6 | Fe 97.2 | Cu 2 | C 0.8 | 12.8 |

From Table 2, it will be understood that iron powder alone, even without an additive, exhibits 6.4 kg/mm$^2$ transverse rupture strength, which is more than sufficient for actual use. The addition of Cu and C to the iron results in various effects, i.e., the addition of C has a remarkable effect of increasing transverse rupture strength, whereas the addition of Cu is not preferable from the standpoint of strength, although the Cu additive is considered to be effective in increasing the wettability between the infiltrant and the iron powder. It was found that a small amount of Cu and the simultaneous addition of C resulted in a remarkable increase in strength.

From the test results described above, the following can be concluded concerning additive elements in the iron-base powder mixture used in this invention: Addition of 0.01–20% Cu is preferable because addition of less than 0.01% has little effect, whereas addition of more than 20% results in a decrease in strength. Addition of 0.01–4.5% C is preferable because the addition of 0.01% has little effect, whereas the addition of more than 4.5% results in an unfavourable decrease in strength because of the formation of a cast-iron structure. In the example described above, the iron-base powder mixture for the filling was an Fe—Cu—C three-element system. However, it is a matter of course that any powder mixture can be designed according to various usages, following the conventional methods of powder metallurgy, which can improve the mechanical and other properties by the addition of such elements as Ni, Cr, Mn, Co, etc.

By the above processes of this invention, consumption of expensive powders such as tungsten can be reduced, and a rotary dresser having a highly accurate grinding surface can be obtained. Moreover, the welding strength between the tungsten-powder layer and iron-base powder layer increases remarkably because of the formation of a network of infiltrant material. In the case of a bushing having reverse tapered grooves, as is shown in FIG. 11, the iron-base powder 8 enters into the grooves and the powder in the grooves swells when infiltrated. Thus, the grooves act as a strong prevention against slippage. Moreover, the infiltrated powder body prevents abnormal vibration because of its high damping capability. Finally, the infiltrated iron-base powder body is lighter than infiltrated tungsten powder, so it is easier to handle.

What is claimed is:

1. A method of producing a rotary dresser, comprising; providing an outer mold member including a super-abrasive material; placing an iron-base powder compact near the center of said mold member; filling a wear resistant metallic powder mixture between said mold member and said compact; and heating the construction while melting an infiltrant thereinto, to form a sintered body bonded by said infiltrant and having said super-abrasive surface at the outside thereof.

2. A method as claimed in claim 1, wherein said wear resistant metallic powder comprises a tungsten base powder mixture.

3. A method as claimed in claim 1, wherein said iron-base powder compact is sintered before being placed in said mold.

4. A method as claimed in claim 1, wherein said iron-base powder compact is infiltrated with said infiltrant before being placed in said mold.

5. A method as claimed in claim 1, wherein said iron-base powder compact is non-sintered when placed in said mold.

6. A method as claimed in claim 1, wherein said iron-base powder compact contains copper in a range of from 0.01% to 20%.

7. A method as claimed in claim 1 or 6, wherein said iron-base powder compact contains carbon in a range of from 0.01% to 4.5%.

8. A method of producing a rotary dresser, comprising; providing an outer mold member including a super-abrasive material; placing a core means near the center of said mold member; concentrically filling, from said mold member, a tungsten base powder mixture and an iron-base powder mixture between said mold member and said core means, placing an infiltrant on the assembly and heating the assembly to infiltrate said infiltrant into said powder mixtures, said infiltrant bonding said powder mixtures, to form a sintered body having said super-abrasive surface at the outside thereof.

9. A method as claimed in claim 8, wherein said core means comprises a bushing, said bushing being made of an iron alloy and having grooves filled in with said iron-base powder mixture.

10. A method as claimed in claim 8, said iron-base powder mixture containing copper and carbon in a range of 0.01% to 20% and 0.01% to 4.5%, respectively.

* * * * *